US005843192A

United States Patent [19]

Kirk et al.

[11] Patent Number: 5,843,192

[45] **Date of Patent: *Dec. 1, 1998**

[54] WASHING COMPOSITION AND USE OF POLYMER TO CLEAN AND PROVIDE SOIL RESISTANCE TO AN ARTICLE

[75] Inventors: Thomas Cleveland Kirk, Ivyland; Curtis Schwartz, Ambler; Richard James Tallent, Lafayette Hill; Thomas Lawrence Pytlewski, Philadelphia, all of Pa.

[73] Assignee: Rohm and Haas Company, Philadelphia, Pa.

[ * ] Notice: The term of this patent shall not extend beyond the expiration date of Pat. No. 5,730,760.

[21] Appl. No.: 676,553

[22] Filed: Jul. 9, 1996

Related U.S. Application Data

[60] Provisional application No. 60/001,034 Jul. 11, 1995.

[51] Int. Cl.[6] ..... D06L 1/16; C11D 3/37

[52] U.S. Cl. ..... 8/137; 510/299; 510/300; 510/517; 510/528; 134/42

[58] Field of Search ..... 8/137; 510/299, 510/300, 517, 528; 134/42

[56] References Cited

U.S. PATENT DOCUMENTS

| | | | |
|---|---|---|---|
| 4,379,059 | 4/1983 | Hockey et al. | 510/522 |
| 4,444,561 | 4/1984 | Denzinger et al. . | |
| 4,772,290 | 9/1988 | Mitchell et al. | 8/111 |
| 4,880,497 | 11/1989 | Pfohl et al. . | |
| 4,921,621 | 5/1990 | Costello et al. . | |
| 5,380,447 | 1/1995 | Kirk et al. . | |
| 5,409,629 | 4/1995 | Shulman et al. . | |
| 5,534,182 | 7/1996 | Kirk et al. . | |

FOREIGN PATENT DOCUMENTS

| | | |
|---|---|---|
| 2104507 | 2/1994 | Canada . |
| 2104728 | 2/1994 | Canada . |
| 2115529 | 8/1994 | Canada . |
| 341205 | 11/1989 | European Pat. Off. . |
| 510246 | 10/1992 | European Pat. Off. . |
| 538228 | 4/1993 | European Pat. Off. . |
| 579295 | 1/1994 | European Pat. Off. . |
| 3124210 | 12/1982 | Germany . |
| 4244386 | 6/1994 | Germany . |
| 4413720 | 10/1995 | Germany . |

OTHER PUBLICATIONS

Mode of Action of Polymers with Dye Transfer–Inhibiting Properties, H.U. Jager and W. Denzinger, Tenside, Surfactants, Deterg. 28(6), pp. 428–433 (1991). (month unknown).

*Primary Examiner*—Alan Diamond
*Attorney, Agent, or Firm*—Ronald S. Hermenau; Kimberly R. Hild

[57] ABSTRACT

The present invention provides a composition useful in a washing process containing at least one vinyl amide polymer. The vinyl amide polymer contains from 5 to 100 weight percent of at least one vinyl amide monomer, and from 0 to 95 weight percent of one or more vinyl ester monomers. The present invention also provides a method of cleaning an article and a method of providing soil resistance to an article using the vinyl amide polymer.

23 Claims, No Drawings

WASHING COMPOSITION AND USE OF POLYMER TO CLEAN AND PROVIDE SOIL RESISTANCE TO AN ARTICLE

This application claims the benefit of provisional application Ser. No. 60/001,034, filed Jul. 11, 1995.

BACKGROUND

This invention relates to a composition used in a washing process which contains at least one vinyl amide polymer. This invention also relates to a method of cleaning an article containing soil and a method of providing soil resistance to an article using the vinyl amide polymer.

One primary objective in a washing process is to clean an article to completely remove soil from it. Where the article is not highly stained, surfactants, builders and enzymes formulated into most detergents are adequate to completely remove soil from the article. When stronger cleaning power is needed to remove soil from the article other products are available. These products are, for example, oxygen and chlorine bleach, or laundry boosters. These products are typically added to the wash cycle in addition to the detergent. In addition, washing with hotter water, using longer wash cycles, pre-soaking the soiled article in an aqueous solution containing detergent, or using a spot pre-treater are helpful for removing soil.

However, where the article is heavily soiled, or where the soil has penetrated into the article, surfactants, builders, enzymes, bleach, or laundry boosters are not always completely effective in removing soil from an article. Spot pre-treaters are useful, but they need to be applied to the stained area prior to washing requiring an inconvenient additional step in the washing process.

Additionally, certain soils are particularly difficult to remove from certain types of articles. For example, oil based soils are particularly difficult to remove from synthetic fabrics. Ground in clay or particulate stains, for example, are particularly difficult to remove from cotton fabrics. In addition, removing soil can be made more difficult when soil which is suspended in the washing process redeposits onto the article.

Soils commonly found on stained articles include oil and oily particulate stains such as frying oils or grease, sauces like tomato or spaghetti sauce, tea or coffee stains, non-saponifiable oil stains such as used motor oil or petroleum oils, grass stains, enzyme sensitive stains such as fats or proteins; or mineral stains such as clays.

Several solutions have been proposed for improving the cleaning of an article. One proposed solution for cleaning of an article is to add a "soil removal agent" to the washing process to increase soil removal from the article during washing. Another proposed solution involves protecting an article with an agent to provide "soil resistance" to the article. The agent which provides soil resistance, hereinafter called a "soil resistance agent," may act to protect the article so that soil is not deposited as easily on the article in comparison to another article not protected by the soil resistance agent. The soil resistance agent may also act to protect the article by making soil on an article easier to remove in comparison to another article which was not protected by the soil resistance agent before being soiled. Another proposed solution involves adding an agent which inhibits soil which has been removed from an article in the washing process from depositing onto the same or different article.

It is desirable to find an agent which will provide more than one type of cleaning benefit. For example, it is desirable to find an agent which preferably removes soil, imparts soil resistance to the article, and inhibits soil deposition.

Certain water soluble polymers have been found to protect textiles from soil redeposition. For example, U.S. Pat. No. 4,444,561 to Denzinger et. al, hereinafter referred to as the "'561 patent," discloses the use of certain copolymers to inhibit soil redeposition. These copolymers contain, as polymerized units, from 50 to 90 weight percent of one or more vinyl esters of $C_1$–$C_4$ aliphatic carboxylic acids, from 5 to 35 weight percent of one or more N-vinyl lactams, and from 1 to 20 weight percent of one or more monomers containing basic nitrogen capable of forming a salt or quaternized product.

However, polymers, such as those disclosed in the '561 patent, which are capable of forming cations, may complex with anionic surfactants under certain wash conditions and cause a decrease in cleaning performance. Cationic polymers may also undesirably promote fabric greying over multiple cycles. The polymers disclosed in the '561 patent are also only shown to protect textiles from soil redeposition.

The problem addressed by the present invention is to provide a polymer which removes soil from an article, inhibits soil deposition, or provides soil resistance to an article, or combinations thereof. Another problem addressed by the present invention is to provide a polymer which is compatible with other components used in a washing process.

STATEMENT OF INVENTION

The present invention provides a composition for a washing process comprising: from 0.01 to 20 weight percent, based on total weight of the composition of at least one vinyl amide polymer, and at least one additive selected from the group consisting of a surfactant, fabric softening agent and combinations thereof, wherein the vinyl amide polymer comprises, as polymerized units, based on total weight of monomer, from 5 to 100 weight percent of at least one vinyl amide monomer and from 0 to 95 weight percent of one or more vinyl ester monomers. Preferably, the vinyl amide polymer contains less than 3 weight percent of one or more acrylamide monomers, and less than 3 weight percent of one or more ethylenically unsaturated carboxylic acid monomers.

The present invention also provides a method of cleaning, comprising: forming a cleaning solution comprising at least one vinyl amide polymer; contacting the cleaning solution with one or more articles, wherein at least one of the articles is an article containing soil; and removing at least a portion of the soil from the article containing soil.

The present invention also provides a method of providing soil resistance to an article, comprising: forming a treatment solution comprising at least one vinyl amide polymer; and contacting the treatment solution with the article to provide soil resistance to the article.

DETAILED DESCRIPTION

By "washing process" we mean any process where an article is cleaned. The washing process includes for example a home laundering, industrial or institutional laundering process; a process for washing hard surfaces such as countertops, dishes, or glasses; or a process for washing automobiles.

Articles which may be cleaned using the vinyl amide polymer are articles which come into contact with soil and which are capable of being washed in a washing process. The articles preferably have one or more hydrophobic surfaces. Examples of articles which may be cleaned using the vinyl amide polymer include fabrics, such as clothing, linens, or upholstery; hard surfaces such as countertops, dishes or glasses; or automobiles. By "clean" we mean to include removing soil from an article, inhibiting soil deposition in a washing process, or providing soil resistance to an article or combinations thereof.

The vinyl amide polymer is preferably water soluble or water dispersible in the washing process.

The vinyl amide polymer is formed from, as polymerized units, of at least one vinyl amide monomer of Formula (I):

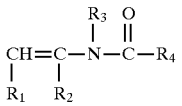

Formula (I)

where $R_1$, $R_2$, and $R_3$ are each independently selected from hydrogen, or a straight, cyclic, or branched chain $C_1$–$C_{10}$ alkyl group. Preferably $R_1$, $R_2$, and $R_3$, are each independently selected from hydrogen or a straight or branched $C_1$ to $C_4$ alkyl group. Most preferably $R_1$ and $R_2$ are hydrogen. Most preferably $R_3$ is hydrogen or a methyl group. $R_4$ is hydrogen, a straight, cyclic or branched chain $C_1$–$C_{18}$ alkyl, aryl, or alkylaryl group, or a substituent of Formula III:

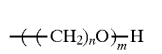

Formula III where n is an integer from 1 to 6 and m is an integer from 1 to 30. Preferably, $R_4$ is hydrogen or a straight or branched $C_1$ to $C_{10}$ alkyl group.

The vinyl amide monomer includes for example N-vinylformamide, N-vinyl acetamide, or N-vinyl-N-methyl acetamide or combinations thereof.

Preferably, the vinyl amide polymer is formed from 5 to 100 weight percent, preferably from 15 to 70 weight percent, and most preferably 20 to 40 weight percent of the vinyl amide monomer based on the total weight of monomer used to form the vinyl amide polymer.

The vinyl amide polymer may optionally be formed from, as polymerized units, of one or more vinyl ester monomers of Formula (II):

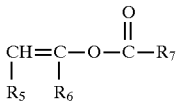

Formula (II)

where $R_5$ and $R_6$ are each independently selected from hydrogen, or a straight, cyclic, or branched chain $C_1$–$C_{10}$ alkyl group; where $R_7$ is selected from hydrogen, a straight, cyclic or branched chain $C_1$–$C_{18}$ alkyl, aryl, or alkylaryl group, or a substituent of Formula (III). Preferably $R_5$ and $R_6$ are each independently selected from hydrogen or methyl. Preferably $R_7$ is a straight or branched $C_1$ to $C_{10}$ alkyl group.

The vinyl ester monomers include for example vinyl acetate, vinyl propionate, vinyl butyrate, vinyl pivalate, vinyl laurate, or vinyl decanoate or combinations thereof.

Preferably, the vinyl amide polymer is formed from 0 to 95 weight percent, more preferably from 30 to 85 weight percent, and most preferably 60 to 80 weight percent of the vinyl ester monomers based on the total weight of monomer used to form the vinyl amide polymer.

The vinyl amide polymer may also be formed from one or more optional other ethylenically unsaturated monomers. The other ethylenically unsaturated monomers are preferably monoethylenically unsaturated. The other ethylenically unsaturated monomers are also preferably nonionic.

Optional other monomers include $C_2$ to $C_{20}$ ethylenically unsaturated monomers for example olefins, such as ethylene, propylene, or isobutylene; styrene; other vinyl ethers such as vinyl methyl ether, vinyl ethyl ether, isopropyl vinyl ether or vinyl n-butyl ether; acrylonitrile; methacrylonitrile; alkyl esters of acrylic or methacrylic acids such as methyl acrylate, ethyl acrylate, butyl acrylate, methyl methacrylate, ethyl methacrylate, butyl methacrylate or isobutyl methacrylate; hydroxyalkyl esters of acrylic or methacrylic acids such as hydroxyethyl acrylate, hydroxypropyl acrylate, hydroxyethyl methacrylate, or hydroxypropyl methacrylate; allyl alcohol; dialkyl esters of maleic acid or fumaric acid such as dibutyl maleate, dihexyl maleate, dioctyl maleate, dibutyl fumarate, dihexyl fumarate or dioctyl fumarate; allyl esters such as allyl acetate; or vinyl carbonate such as vinylene carbonate or combinations thereof.

Preferably, the vinyl amide polymer is formed from 0 to 50 weight percent, more preferably from 1 to 20 weight percent, and most preferably from 1 to 10 weight percent of the optional other ethylenically unsaturated monomers based on the total weight of monomer used to form the vinyl amide polymer.

The vinyl amide polymer preferably contains less than 3 weight percent of one or more ethylenically unsaturated carboxylic acid monomers, based on the total weight of monomer. Preferably the vinyl amide polymer contains from 0 to 1.5 weight percent, and more preferably from 0 to 0.5 weight percent of ethylenically unsaturated carboxylic acid monomers.

The ethylenically unsaturated carboxylic acid monomers contain one or more carboxylic acid groups. The carboxylic acid groups may be neutralized or unneutralized. Examples of ethylenically unsaturated carboxylic acid monomers include acrylic acid, methacrylic acid, maleic acid, itaconic acid or salts thereof.

The vinyl amide polymer preferably contains less than 3 weight percent of one or more acrylamide monomers. Preferably the vinyl amide polymer contains from 0 to 1.5 weight percent and more preferably from 0 to 0.5 weight percent of acrylamide monomers.

The acrylamide monomers are derived from acrylamide. Examples of monomers derived from acrylamide include acrylamide, N,N-dimethylacrylamide, acrylamidoalkylenesulfonic acid, such as 2-acrylamido-2-methyl-propanesulfonic acid, or acrylamide monomers of Formula (IV).

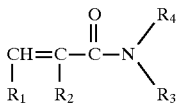

Formula (IV)

where $R_1$, $R_2$, $R_3$, and $R_4$ are independently selected from hydrogen or a $C_1$ to $C_{10}$ alkyl group.

The weight average molecular weight (Mw) of the vinyl amide polymer is preferably from 5,000 to 200,000; more preferably from 10,000 to 100,000; and most preferably from 20,000 to 60,000 as measured by gel permeation chromatography using dimethylformamide as the solvent and poly(vinylpyrrolidone) of 40,000 weight average molecular weight as a standard.

The vinyl amide polymer useful in the present invention may be prepared by conventional free radical polymerization methods well known to those skilled in the art. For example, the vinyl amide polymer may be prepared by a solvent polymerization process, water in oil emulsion polymerization process, oil in water emulsion polymerization process, or suspension polymerization process. Preferably, the vinyl amide polymer is prepared by an oil in water emulsion process. Suitable polymerization processes may be found in U.S. Pat. Nos. 4,774,285; 5,300,566; or 5,086,111.

The vinyl amide polymer useful in the present invention may be used in a process where a soiled article is being cleaned. In a process where a soiled article is being cleaned, a cleaning solution is formed containing the vinyl amide polymer. The concentration of the vinyl amide polymer in the cleaning solution is preferably from 5 to 1000 ppm, more preferably from 15 to 75 ppm. and most preferably from 30 to 50 ppm, by weight, based on the total weight of the cleaning solution.

The cleaning solution containing the vinyl amide polymer preferably disperses or solubilizes the vinyl amide polymer. The cleaning solution may be aqueous or nonaqueous. For example the vinyl amide polymer may be dissolved or dispersed in water or in one or more solvents, such as those which may be used in the composition for a washing process described hereinafter; or combinations thereof. Preferably the cleaning solution is aqueous.

The cleaning solution may optionally contain additional components typically used in a washing process which are well known to those skilled in the art. Examples of additional components include surfactants, builders, inert diluents, buffering agents, bleaching agents, corrosion inhibitors, graying inhibitors, enzymes, anti-redeposition agents, stabilizers, perfumes, opacifiers, whiteners or combinations thereof. Preferably the cleaning solution contains at least one surfactant in addition to the vinyl amide polymer.

Preferably, the cleaning solution is formed by combining a detergent composition containing the vinyl amide polymer with water. The detergent composition, described hereinafter, may contain in addition to the vinyl amide polymer, at least one surfactant, one or more builders, solvents, water, inert diluents, buffering agents, fabric softening agents, bleaching agents, corrosion inhibitors, dye deposition inhibiting agents, graying inhibitor, enzymes, anti-redeposition agents, stabilizers, perfumes, whiteners, or combinations thereof. The detergent composition is prepared by techniques well known to those skilled in the art.

The cleaning solution is contacted with one or more articles, where at least one article contains soil. Contacting can be carried out, for example, immersing the articles in the cleaning solution and agitating the articles in the cleaning solution containing the vinyl amide polymer. Contacting can also be accomplished by wiping, spraying, or padding the cleaning solution onto the articles.

The articles are contacted with the cleaning solution for a time sufficient to bring the vinyl amide polymer in contact with the articles and to remove at least a portion of soil from the article containing soil. The necessary contacting time generally will depend on the washing process. However, the contacting time will generally be from 1 second to 1 hour, and more preferably from 2 minutes to 30 minutes. For example, when the washing process is a wash cycle of a laundering process, the contacting time will typically lasts from 5 minutes to 1 hour, more preferably from 10 minutes to 30 minutes. In a process for cleaning a hard surface such as a countertop, the contacting time may typically be from 1 second to 5 minutes and more preferably from 5 seconds to 15 seconds.

The contacting of the cleaning solution with the articles removes at least a portion of soil from the article containing soil. Preferably, the portion of soil removed from the article is enough to provide an increase of at least one reflectance unit, more preferably at least 5 reflectance units, in the article which was cleaned with the vinyl amide polymer relative to an article not cleaned with the vinyl amide polymer.

In addition to removing a portion of soil from the article, the contacting of cleaning solution with the articles preferably promotes cleaning by inhibiting soil deposition, or by imparting soil resistance to the articles, or combinations thereof. For example, contacting the articles with the cleaning solution preferably inhibits soil which has been removed from the article from depositing onto the same or different article. Contacting the articles with the cleaning solution preferably imparts soil resistance to the articles to provide cleaning benefits in subsequent cleanings.

In another embodiment of the present invention a method is provided for imparting soil resistance to an article. Soil resistance of an article is provided by contacting a treatment solution containing the vinyl amide polymer with the article.

The treatment solution preferably contains the vinyl amide polymer at a concentration of from 5 to 1000 ppm, more preferably from 15 to 75 ppm, and most preferably from 30 to 50 ppm, by weight, based on the total weight of the treatment solution.

The treatment solution preferably disperses or solubilizes the vinyl amide polymer so that it is easily contacted with the article. The treatment solution may be aqueous or nonaqueous. For example the vinyl amide polymer may be dissolved or dispersed in water or in one or more solvents, such as those which may be used in the composition for a washing process described hereinafter; or combinations thereof Preferably the treatment solution is aqueous.

The treatment solution may optionally contain additional components such as surfactants, builders, inert diluents, buffering agents, bleaching agents, corrosion inhibitors, graying inhibitors, enzymes, anti-redeposition agents, stabilizers, perfumes, opacifiers, whiteners or combinations thereof. Preferably the treatment solution contains at least one surfactant or at least one fabric softening agent or combinations thereof.

The treatment solution is contacted with the article to bring the vinyl amide polymer in contact with the article. Contacting may be carried out for example by immersing the article in the treatment solution and agitating the article in the treatment solution. The treatment solution may also be contacted with the article for example by spraying, wiping, or padding the treatment solution onto the article.

The treatment solution is contacted with the article for a time sufficient to allow the vinyl amide polymer to come into contact with the article. Preferably, the contact time is for at least 10 seconds and more preferably is from 30 seconds to one hour.

To provide soil resistance to the article, preferably at least 0.001 milligrams of the vinyl amide polymer per gram of article, and more preferably from 0.1 milligrams to 0.5 milligrams of the vinyl amide polymer per gram of article remains on the article after contacting the treatment solution with the article. For example, if the vinyl amide polymer is added to the wash cycle of a laundering process, preferably at least 0.001 milligrams of the vinyl amide polymer remains on the article per gram of article through the completion of the rinse and spin cycle.

In a preferred embodiment of the present invention, the vinyl amide polymer is added to a treatment solution which is used in a washing process. For example, the vinyl amide polymer may be added to a cleaning solution, previously defined herein, which is used for example during one or more wash cycles of a home, institutional or industrial laundering process of fabric. The vinyl amide polymer may also be added to a treatment solution used in a rinse cycle of a laundering process. The vinyl amide polymer may also be added to a treatment solution used in a fabric softening or souring cycle of a laundering process. The vinyl amide polymer may also be added, for example, to a treatment solution used to clean upholstery.

When the vinyl amide polymer is added to a treatment; solution used in a washing process, it may be added to the washing process separately or may be added to the washing process with other chemicals. For example the vinyl amide polymer may be formulated into a composition, such as a detergent composition or fabric softening composition, which is then added to the washing process.

The present invention also provides a composition containing at least one vinyl amide polymer which is added to a washing process. The composition may be for example a detergent composition used to clean the article. The composition may also be for example a fabric softening composition when the article is fabric.

The composition which may be added to the washing process comprises from 0.01 to 20 weight percent of at least one vinyl amide polymer and at least one additive selected from a surfactant, fabric softening agent, or combinations thereof Preferably the concentration of vinyl amide polymer in the composition is from 0.1 to 10 weight percent, more preferably from 0.4 to 5 weight percent based on the total weight of the composition.

Other additives contained in the washing composition will depend on the intended use for the composition in the washing process. Other additives include for example one or more builders, solvents, water, inert diluents, buffering agents, bleaching agents, corrosion inhibitors, graying inhibitors, enzymes, anti-redeposition agents, stabilizers, perfumes, opacifiers, whiteners or combinations thereof.

The composition may be a solid or liquid composition. If the composition is solid, the composition may be in any of the usual physical forms, such as for example powders, beads, flakes, bars, tablets, noodles, pastes, and slurries.

If the composition is a detergent composition intended for cleaning it is prepared in the conventional manner and is usually based on surfactants, and optionally, on either precipitant or sequestrant builders. The detergent composition for cleaning may contain, in addition to the at least one vinyl amide polymer may contain at least one surfactant, one or more builders, solvents, water, inert diluents, buffering agents, fabric softening agents, bleaching agents, corrosion inhibitors, dye deposition inhibiting agents, graying inhibitor, enzymes, anti-redeposition agents, stabilizers, perfumes, whiteners, or combinations thereof. Preferably the detergent composition contains at least one surfactant.

If the composition is a fabric softening composition used for softening fabric, it may comprise for example, from 25 to 95 weight percent water; from 2 to 60 weight percent of at least one fabric softening agent, and from 0.01 to 20 weight percent of at least one vinyl amide polymer. The fabric softening composition may also contain other adjuvants well known to those skilled in the art. For example, viscosity modifiers, germicides, fluorescers, perfumes, acids, soil resistant agents, colorants, anti-oxidants, anti-yellowing aids, and ironing aids may be included in the composition. Additionally, the fabric softening composition may include solvents.

In general, the surfactants constitute from 0 to 50, preferably from 2 to 50 weight percent, and more preferably 5 to 45 percent by weight of the composition. Suitable surfactants include for example nonionic, anionic, cationic, or amphoteric surfactants. The surfactants usable in the composition may also be soaps.

Anionic surfactants include for example from $C_8$ to $C_{12}$ alkylbenzenesulfonates, from $C_{12}$ to $C_{16}$ alkanesulfonates, from $C_{12}$ to $C_{16}$ alkylsulfates, from $C_{12}$ to $C_{16}$ alkylsulfosuccinates or from $C_{12}$ to $C_{16}$ sulfated ethoxylated alkanols.

Nonionic surfactants include for example from $C_6$ to $C_{12}$ alkylphenol ethoxylates, from $C_{12}$ to $C_{20}$ alkanol alkoxylates, and block copolymers of ethylene oxide and propylene oxide. Optionally, the end groups of polyalkylene oxides can be blocked, whereby the free OH groups of the polyalkylene oxides can be etherified, esterified, acetalized and/or aminated. Another modification consists of reacting the free OH groups of the polyalkylene oxides with isocyanates. The nonionic surfactants also include $C_4$ to $C_{18}$ alkyl glucosides as well as the alkoxylated products obtainable therefrom by alkoxylation, particularly those obtainable by reaction of alkyl glucosides with ethylene oxide.

Cationic surfactants contain hydrophilic functional groups where the charge of the functional groups are positive when dissolved or dispersed in an aqueous solution. Typical cationic surfactants include for example amine compounds, oxygen containing amines, and quaternary amine salts.

Amphoteric surfactants contain both acidic and basic hydrophilic groups. Amphoteric surfactants are preferably derivatives of secondary and tertiary amines, derivatives of quaternary ammonium, quaternary phosphonium or tertiary sulfonium compounds. The cationic atom in the quaternary compound can be part of a heterocyclic ring. The amphoteric surfactant preferably contains at least one aliphatic group, containing about 3 to about 18 carbon atoms. At least one aliphatic group preferably contains an anionic water-solubilizing group such as a carboxy, sulfonate, sulfato, phosphato, or phosphono group.

Generally, anionic surfactants, such as linear alkyl sulfonate (LAS) is preferred for use in solid detergent compositions. Nonionic and anionic surfactant mixtures such as alcohol ethoxylates and LAS are preferred in liquid detergent compositions of this invention.

The composition contains from 0 to 85 weight percent, and preferably from 5 to 50 weight percent of one or more builders based on the total weight of the composition.

Examples of builders which may be present in the composition include for example phosphates such as pyrophosphates, polyphosphates, or sodium tripolyphosphate. Further examples are zeolites, sodium carbonate, poly(carboxylic acids), nitrilotriacetic acid, citric acid, tartaric acid, the salts of the aforesaid acids and the monomeric, oligomeric or polymeric phosphonates.

The amounts of the one or more builders used in the preparation of the composition based on the total weight of the composition are, typically for example, up to 85 weight percent sodium carbonate, up to 45 weight percent phosphates, up to 40 weight percent zeolites, up to 30 weight percent nitrilotriacetic acid and phosphonates, and up to 30 weight percent polycarboxylic acids.

The amount of builder in a liquid composition preferably is from 0 to 30 weight percent, more preferably from 1 to 20 weight percent based on the total weight of the composition. Suitable builders in a liquid fabric washing composition include for example citric acid and its salts, tripolyphosphate, fatty acid soap, or combinations thereof.

Solvents, inert diluents, or water may be used in the composition for dissolving, suspending or dispersing the vinyl amide polymer.

Liquid compositions can contain up to 80 weight percent water or solvents or combinations thereof. Typical solvents which may be used include oxygen containing solvents such as alcohols, esters, glycol, and glycol ethers. Alcohols that may be used in the present compositions include for example methanol, ethanol, isopropanol, and tertiary butanol. Esters which may be used include for example amyl acetate, butyl acetate, ethyl acetate, esters of glycols. Glycols and glycol ethers that are useful as solvents include for example ethylene glycol, propylene glycol, and oligomers of ethylene or propylene glycol.

Solid detergent compositions preferably contain up to 60 weight percent of one or more solid inert diluents such as sodium sulfate, sodium chloride, sodium borate, or selected polymers such as polyethylene glycol or polypropylene glycol.

The composition may contain 0 to about 50 weight percent of one or more buffering agents. Buffering agents include for example one or more alkali metal salts such as silicates, carbonates, or sulfates. Buffering agents also include for example, organic alkalis, such as triethanolamine, monoethanolamine, and triisopropanolamine.

Fabric softening agents typically include quaternary ammonium salts such as for example ditallowdimethylammonium chloride.

Other optional additives to compositions especially for detergent compositions are bleaching agents, used in an amount of up to 30 weight percent; corrosion inhibitors, such as silicates, used in an amount of up to 25 weight percent; dye deposition inhibiting agents, used in an amount up to 20 weight percent; and graying inhibitors used in an amount of up to 5 weight percent.

Suitable bleaching agents are, for example, perborates, percarbonates or chlorine-generating substances, such as chloroisocyanurates. Suitable silicates used as corrosion inhibitors are, for example, sodium silicate, sodium disilicate and sodium metasilicate. Suitable dye deposition inhibiting agents include for example poly(vinyl pyrrolidone). Examples of graying inhibitors are carboxymethylcellulose, methylcellulose, hydroxypropylmethylcellulose and graft copolymers of vinyl acetate and polyalkylene oxides having a molecular weight of 1,000 to 15,000.

EXAMPLES

Some embodiments of the present invention will now be described in detail in the following examples. The weight average molecular weight of the vinyl amide polymer useful in the present invention was measured in all examples by gel permeation chromatography using dimethylformamide as the reaction solvent and poly(vinyl pyrrolidone) having a weight average molecular weight of 40,000 as the standard.

The vinyl amide polymer of the present invention was tested for its ability to clean an article and to provide soil resistance to an article.

The following 2-cycle test method was used in example 1 to measure the ability of the vinyl amide polymer to remove soil and to impart soil resistance to an article. As a control, the 2- cycle test method was also performed using no vinyl amide polymer in the first and second cycles.

For the first test cycle, to an 83.3 liter Kenmore Fabric Care Series 80 Model 110 washing machine was added 1) two cotton terry bath towels each weighing 681 grams, 2) 5 stained test fabrics of each type of fabric tested, and 3) 15 unstained test fabrics of each type of fabric tested.

For each vinyl amide polymer tested, two types of test fabrics were used: a blended fabric composed of 65 weight percent polyester and 35 weight percent cotton (poly/cotton), and a fabric consisting of 100 weight percent polyester. These test fabrics were obtained from TestFabrics in Middlesex, N.J. and were cut into approximately 13 cm by 13 cm squares. To remove nonpermanent fabric finishes, the test fabrics were washed in hot (68° C.) water with ordinary laundry detergent and dried before testing.

Test fabrics were stained by applying approximately 2.2 grams of Ragu® Traditional Spaghetti Sauce. The stains were applied by stretching the fabric across the base of a paper cup and brushing the stain into the fabric. The stains were allowed to dry overnight in each test.

The washer was then filled with 45 liters of tap water at a temperature of about 32° C. and hardness of about 150 ppm to form a solution. While the washer was filling, 15 grams of detergent A was added. Detergent A was Ultra Tide®, a registered trademark of the Procter & Gamble Company and the composition for detergent B is shown in TABLE 7. When the detergent was dispersed, the vinyl amide polymer to be tested was added to provide a final concentration of 75 ppm by weight based on the total weight of the solution, excluding the weight of the fabric.

The washing machine was then started and went through a 15 minute wash cycle, followed by one rinse cycle using tap water at a temperature of about 18° C. for 2 minutes. Also, each wash or rinse cycle was ended with a spin cycle to remove the wash liquor. Following the washing and rinse cycles, the test fabrics were removed from the washer and air dried.

The test fabrics which were stained and washed during the first cycle were evaluated for soil removal by measuring the reflectance of the fabric using a calorimeter (Colorguard® System/05, manufactured by Gardner). A higher reflectance value corresponds to a whiter fabric which is desirable because it indicates a greater amount of soil was removed from the fabric. For each fabric type, an average reflectance was calculated by averaging together the reflectance values of the 5 stained test fabrics.

The average reflectance for each stained fabric type was then compared to the average reflectance of the same type of stained test fabric which was washed through the first cycle with no added vinyl amide polymer (the control). The soil removal value ($\Delta Y$) shown in TABLE 1 is the difference in the average reflectance of the stained test fabric washed with the vinyl amide polymer minus the average reflectance value of the same type of stained test fabric washed without the polymer. A positive $\Delta Y$ indicates the vinyl amide polymer is removing soil in comparison to the no polymer control. A zero or negative $\Delta Y$ value means the vinyl amide polymer is not removing soil from the fabric in comparison to the no polymer control.

For the second test cycle, 5 of the 15 unstained test fabrics of each fabric type were stained according to the procedure described previously and allowed to dry overnight. After allowing the stained fabrics to dry, to the same Kenmore washer was added 1) two cotton terry bath towels, each weighing approximately 681 grams, 2) the 5 test fabrics of each fabric type that were stained after the first cycle, and 3) 5 unstained test fabrics of each fabric type which went through the first test cycle.

The washer was then filled with 45 liters of tap water at a temperature of about 32° C. and hardness of about 150 ppm. After the washer was filled with water, the same type and amount of detergent used in the first cycle was added and agitation was started. No vinyl amide polymer was added during this second test cycle. The washing machine then went through the same wash, rinse, and spin cycles as in the first cycle. After the second cycle was complete, the test fabrics were air dried.

The test fabrics which had been stained after the first cycle and obtained from the second cycle were measured for soil release by measuring their reflectance with the colorimeter. A higher reflectance value indicates that the fabric is whiter or that more soil was released from the fabric in comparison to a fabric with a lower reflectance value. For each fabric type, an average reflectance was calculated by averaging together the 5 reflectance values.

Each average reflectance value was compared to the average reflectance of the same fabric type which was stained after the first cycle but washed through the first and second cycles with no added vinyl amide polymer (the control). The soil release value (ΔR) shown in TABLE 1 is the difference in the average reflectance of the stained test fabric obtained from the second cycle minus the average reflectance value of the same test fabric type stained after the first cycle but washed through the first and second cycles with no added vinyl amide polymer.

A positive ΔR value indicates that the vinyl amide polymer is imparting soil resistance to the fabric by improving the soil release of the fabric in comparison to a fabric treated with no polymer before staining (the control). A zero or negative ΔR value means the vinyl amide polymer is not improving the soil release of the fabric in comparison to the control.

The results of evaluating the vinyl amide polymer useful in the present invention for soil removal and soil release of an article are shown in TABLE 1. TABLE 1 shows that the vinyl amide polymer useful in the present invention removes soil more effectively than the no polymer control. TABLE 1 also shows that the vinyl amide polymer, when contacted with a fabric before staining, improves the soil resistance of the fabric. For example, example 1 shows that more soil was released from a fabric that was contacted with a vinyl amide polymer before staining in comparison to a fabric not contacted with the vinyl amide polymer before staining.

TABLE 1

Effectiveness of Vinyl Amide Polymer in Removing and Releasing Soil

| | Composition of | | Soil Removal (ΔY) | | Soil Release (ΔR) | |
|---|---|---|---|---|---|---|
| Example | Polymer | Mw | Poly/Cot | PE | Poly/Cot | PE |
| No Polymer | — | — | 0.0 | 0.0 | 0.0 | 0.0 |
| Example 1 | 30 NVF/70 VA | 76,151 | 3.4 | 7.7 | 0.5 | 8.9 |

TABLE 2 further shows the ability of the vinyl amide polymer in improving the soil resistance of an article. The soil release values obtained in TABLE 2 for examples 2–6 were obtained using the same 2 cycle test method as used in example 1, except that in example 3, 245 grams of detergent B was used instead of 15 grams of detergent A. The composition of detergent B is shown in TABLE 7. Examples 1–6 indicate the vinyl amide polymer useful in the present invention improved the release of spaghetti soil from a fabric in comparison to a fabric not treated with the vinyl amide polymer before staining.

TABLE 2

Effectiveness of Vinyl Amide Polymer in Promoting Soil Release

| | Composition of Vinyl | | | Soil Release (ΔR) | |
|---|---|---|---|---|---|
| Example | Amide Polymer | Mw | Det. | Poly/Cot. | PE |
| No Polymer | — | — | A | 0.0 | 0.0 |
| No Polymer | — | — | B | 0.0 | 0.0 |
| Example 2 | 100 NVF | n.d. | A | 4.3 | 2.9 |
| Example 3 | 30 NVF/70 VA | 76,151 | B | 1.7 | 0.1 |
| Example 4 | 20 NVF/80 VA | 60,856 | A | 1.9 | 6.6 |
| Example 5 | 50 NVA/50 VA | 24,315 | A | 7.8 | 7.6 |
| Example 6 | 20 NVA/80 VA | 26,096 | A | 1.5 | 7.4 |

The vinyl amide polymer useful in the present invention was also evaluated for its ability to improve soil resistance of an article when added to a rinse-type cycle of a washing process.

The vinyl amide polymer was evaluated by adding the following to the Kenmore washer used in examples 1–6: 1) two cotton terry bath towels each weighing 681 grams and 2) 5 unstained poly/cotton test fabrics and 5 unstained polyester test fabrics. The washer was filled with approximately 45 liters of tap water having a hardness of about 150 ppm and temperature of about 18° C. After the washer was filled, the vinyl amide polymer was added in an amount to provide a concentration of 75 ppm by weight vinyl amide polymer based on the total weight of the solution, excluding the weight of the fabric.

The washer then went through a 7 minute agitation cycle, a 7 minute soak cycle, a 7 minute agitation cycle, and a spin cycle. Upon completion of the spin cycle, the test fabrics were removed and allowed to dry completely. The test fabrics were stained with spaghetti sauce, according to the procedure used for examples 1–6.

After the stained fabrics were dried, the stained fabrics were washed according to the second cycle test procedure used in examples 1–6, except that no unstained test fabrics were added. The soil release of the resulting washed test fabrics was measured according to the procedure used in Examples 1–6.

TABLE 3 shows that the vinyl amide polymer useful in the present invention is effective in imparting soil resistance to an article when the vinyl amide polymer is added to a rinse type cycle of a washing process containing the article. Example 7, a copolymer of N-vinyl formamide and vinyl acetate, effectively promoted the release of spaghetti soil from polyester fabric in comparison to test fabric not contacted with the vinyl amide polymer in the rinse cycle.

TABLE 3

Effectiveness of Vinyl Amide Polymer in Providing Soil Resistance When Added to a Rinse Cycle

| Example | Composition of Vinyl Amide Polymer | Mw | Det. | Soil Release (ΔR) |
|---|---|---|---|---|
| | | — | | PE |
| No Polymer | — | | A | 0.0 |
| Example 7 | 30 NVF/70 VA | 116,476 | A | 7.3 |

The vinyl amide polymer useful in the present invention was evaluated for its effectiveness in inhibiting the deposition of soil onto an article. Soil deposition was measured in a two cycle test using used motor oil as the soil. This test was also carried out using no vinyl amide polymer as a control. The procedure used was as follows:

To the Kenmore washing machine described previously were added 1) two cotton terry bath towels each weighing 681 grams, 2) 5 stained poly/cotton and 5 stained polyester test fabrics, and 3) 15 unstained poly/cotton and 15 unstained polyester test fabrics.

The stained test fabrics were prepared according to the procedure described in Examples 1–6 except that the fabrics were stained by applying approximately 0.8 to 0.9 grams of used motor oil to the fabric instead of spaghetti sauce. The stains were allowed to dry overnight in each test.

The washer was then filled with 45 liters of tap water at a temperature of about 32° C. and hardness of about 150 ppm to form a solution. After the washer was almost filled, 15 grams of detergent A was added and the vinyl amide polymer was added to provide a final concentration of 75 ppm polymer by weight based on the total weight of the solution, excluding the weight of the fabric. After the washer was filled, agitation was started.

The washing machine then went through a 15 minute wash cycle, followed by one rinse cycle using tap water at a temperature of about 18° C. for 2 minutes. Also, each wash or rinse cycle was ended with a spill cycle to remove the liquor. Following the washing and rinse cycles, the test fabrics were removed from the washer and air dried overnight. Five unstained test fabrics of each type obtained from the first cycle were measured for soil deposition according to the procedure described hereinafter.

After the fabrics were dried, 5 poly/cotton and 5 polyester test fabrics which were unstained during the first cycle were stained with used motor oil according to the procedure described previously.

To begin the second cycle, to the same washer was added 1) two cotton terry bath towels each weighing 681 grams, 2) the 5 poly/cotton and 5 polyester test fabrics stained after the first cycle, and 3) 5 unstained poly/cotton and 5 unstained polyester test fabrics which went through the first wash cycle.

The washer was then filled with 45 liters of tap water at a temperature of about 32° C. and hardness of about 150 ppm to form a solution. After the washer was almost filled, the same amount of detergent A was added as in the first cycle. No vinyl amide polymer was added during the second cycle. After the washer was filled, agitation was started. The washing machine then went through the same wash, rinse, and spin cycles as in the first cycle.

After the second cycle was complete, the test fabrics were air dried and the test fabrics which were unstained in the second wash cycle were measured for soil deposition.

The effectiveness of the vinyl amide polymer to inhibit soil deposition was evaluated by measuring the reflectance of each unstained test fabric obtained from the first and second cycles using the calorimeter used in examples 1–7. An average reflectance was calculated for each unstained fabric type obtained after the first and second wash cycles. The average reflectance for each type of unstained fabric was then compared to the average reflectance of each unstained fabric type obtained from the same cycle and washed with no vinyl amide polymer.

The ΔW value shown for each test cycle in TABLE 4 is the difference in the average reflectance of the unstained test fabric washed with the vinyl amide polymer in the first cycle minus the average reflectance of the unstained test fabric washed without the vinyl amide polymer. A positive ΔW value indicates that the vinyl amide polymer is inhibiting the deposition of soil.

The results in TABLE 4 demonstrate that the vinyl amide polymer is effective in inhibiting the deposition of soil onto an article. The results in TABLE 4 demonstrate the vinyl amide polymer is effective in inhibiting the deposition of soil in the first cycle of a wash process (see $\Delta W_1$). The vinyl amide polymer is also effective to provide soil resistance to an article so that soil is inhibited from depositing onto the article in a subsequent cleaning step where no polymer is added (see $\Delta W_2$). Example 8, a copolymer of N-vinyl formamide and vinyl acetate effectively inhibited the redeposition of motor oil in the first cycle, where the vinyl amide polymer was added and in the second cycle where no vinyl amide polymer was added in comparison to the no polymer control.

TABLE 4

Effectiveness of Vinyl Amide Polymer in Inhibiting Soil Deposition of Motor Oil

| | Composition of | | Inhibition of Deposition of 1st cycle Soil ($\Delta W_1$) | | Inhibition of Deposition of 2nd cycle Soil ($\Delta W_2$) | |
|---|---|---|---|---|---|---|
| Example | Polymer | Mw | Poly/Cot | PE | Poly/Cot | PE |
| No Polymer | — | — | 0.0 | 0.0 | 0.0 | 0.0 |
| Example 1 | 30 NVF/ 70 VA | 76,151 | 9.6 | 37.2 | 24.0 | 60.0 |

The vinyl amide polymer useful in the present invention may be formulated for example, into detergent compositions. TABLE 5 shows some examples of liquid detergent compositions containing the vinyl amide polymer which may be prepared. Formulation A is built with citrate and fatty acid soap; formulation B is built with phosphate; and formulation C contains no builder. TABLE 6 shows some examples of powder detergent formulations containing the vinyl amide polymer which can be prepared. Formulation D is built with tripolyphosphate; formulation E is built with pyrophosphate; and formulation F is built with zeolite.

TABLE 5

Typical Liquid Detergent Compositions Containing Vinyl Amide Polymer

| Ingredient | A | B | C |
|---|---|---|---|
| Linear alkyl benzene sulfonate | 8 wt % | 7 wt % | 19 wt % |
| Alcohol ether sulfate | 16 wt % | — | — |
| Nonionic surfactant | 6 wt % | 3 wt % | 15 wt % |
| Enzyme | 0.5 wt % | 0.5 wt % | 0.75 wt % |
| Vinyl Amide Polymer | 2.0 wt % | 2.0 wt % | 2.0 wt % |
| Sodium citrate | 6.0 wt % | — | — |
| Fatty Acid Soap | 10 wt % | — | — |
| Tripolyphosphate | — | 23 wt % | — |
| Propylene glycol | 8 wt % | — | 4 wt % |
| Ethanol | 4 wt % | — | 8.5 wt % |
| Sodium Xylene Sulfonate | — | — | — |
| Borax | — | 3.0 | — |
| Glycerin | — | 6.0 | — |
| Optical Brightener | 0.15 wt % | 0.10 wt % | 0.25 wt % |
| Water | Balance | Balance | Balance |

TABLE 6

Typical Liquid Detergent Compositions Containing Vinyl Amide Polymer

| Ingredient | D | E | F |
|---|---|---|---|
| Linear alkyl benzene sulfonate | 5 wt % | 5 wt % | 7.5 wt % |
| Lauryl sulfate | 8 wt % | 13 wt % | — |
| Alcohol ether sulfate | 3 wt % | — | — |
| Nonionic surfactant | 1.5 wt % | 2.0 wt % | — |
| Sodium Perborate | — | — | 22.5 wt % |
| Anti-redeposition agent | — | — | 0.5 wt % |
| Sodium polyacrylate | 0.5 wt % | 0.5 wt % | 0.5 wt % |
| Vinyl Amide Polymer | 2.0 wt % | 2.0 wt % | 2.0 wt % |
| Tripolyphosphate | 30.0 wt % | — | — |
| Pyrophosphate | — | 18.0 wt % | — |
| Zeolite A | — | — | 25.0 wt % |
| Sodium Carbonate | 10 wt % | 13 wt % | 7.5 wt % |
| Sodium silicate | 6 wt % | 5 wt % | 1.5 wt % |
| Enzyme | 0.5 wt % | 0.5 wt % | 0.5 wt % |
| Optical Brightener | 0.2 wt % | 0.2 wt % | 0.2 wt % |
| Sodium Sulfate | 15.0 wt % | 24.0 wt % | 20.0 wt % |
| Water | Balance | Balance | Balance |

TABLE 7

Detergent Composition B

| Ingredient | Weight Percent |
|---|---|
| Sodium Carbonate | 15 |
| Tergitol ® 24-L-6 | 3 |
| Silicone Defoamer | 2 |
| Linear Alkyl sulfonate | 9.4 |
| Zeolite | 20 |
| Stearic acid | 3 |
| Sodium silicate | 2.6 |
| Sodium sulfate | 45.0 |

TABLE 8

Key To Abbreviations Used In TABLES 1–7

| ABBREVIATION | KEY |
|---|---|
| Det. | detergent |
| n.d. | no data |
| NVA | percent by weight N-vinyl-N-methyl acetamide |
| NVF | percent by weight N-vinyl formamide |
| PE | 100 weight percent Polyester |
| Poly/Cot. | 65 weight percent Polyester/35 weight percent Cotton |
| VA | percent by weight vinyl acetate |

We claim:

1. A composition for a washing process comprising: from 0.01 to 20 weight percent, based on total weight of the composition of at least one vinyl amide polymer, and at least one additive selected from the group consisting of a surfactant, fabric softening agent and combinations thereof;

wherein the vinyl amide polymer provides cleaning during the washing process, has a weight average molecular weight from 5,000 to 200,000, and comprises, as polymerized units, based on total weight of monomer, from 5 to 100 weight percent of at least one vinyl amide monomer, having the structure of Formula (I),

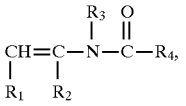

Formula (I)

from 0 to 95 weight percent of one or more vinyl ester monomers, less than 3 weight percent of one or more acrylamide monomers, and less than 3 weight percent of one or more ethylenically unsaturated carboxylic acid monomers wherein $R_1$, $R_2$, and $R_3$ are each independently hydrogen, or a straight, cyclic, or branched chain $C_1$–$C_{10}$ alkyl group;

wherein $R_4$ is hydrogen, a straight or branched chain $C_1$–$C_{18}$ alkyl, aryl, or alkylaryl group, or a substituent of Formula (III),

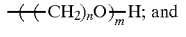

Formula (III)

wherein n is an integer from 1 to 6 and m is an integer from 1 to 30.

2. The composition of claim 1, wherein the vinyl ester monomers have the structure of Formula (II):

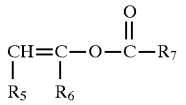

Formula (II)

wherein $R_5$ and $R_6$ are each independently hydrogen, or a straight, cyclic, or branched chain $C_1$–$C_{10}$ alkyl group;

wherein $R_7$ is hydrogen, a straight or branched chain $C_1$–$C_{18}$ alkyl, aryl, or alkylaryl group, or a substituent of Formula (III),

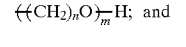

Formula (III)

wherein n is an integer from 1 to 6 and m is an integer from 1 to 30.

3. The composition of claim 1, wherein the vinyl amide monomer is selected from the group consisting of: N-vinylformamide, N-vinyl acetamide, N-vinyl-N-methyl acetamide and combinations thereof.

4. The composition of claim 1, wherein the one or more vinyl ester monomers are selected from the group consisting of: vinyl acetate, vinyl propionate, vinyl butyrate, vinyl pivalate, vinyl laurate, vinyl decanoate, and combinations thereof.

5. The composition of claim 1, wherein the vinyl amide polymer comprises from 15 to 70 weight percent of the vinyl amide monomer based on the total monomer weight.

6. The composition of claim 1, wherein the vinyl amide polymer comprises from 30 to 85 weight percent of the vinyl ester monomers based on the total monomer weight.

7. The composition of claim 1, wherein the vinyl amide polymer is a copolymer comprising, as polymerized units, N-vinyl formamide and vinyl acetate.

8. The composition of claim 1, wherein the vinyl amide polymer further comprises from 1 to 20 weight percent of one or more other nonionic ethylenically unsaturated monomers.

9. The composition of claim 1, further comprising at least one additive selected from builders, solvents, water, inert diluents, buffering agents, bleaching agents, corrosion inhibitors, graying inhibitors, enzymes, anti-redeposition agents, stabilizers, perfumes, whiteners, or combinations thereof.

10. The composition of claim 1, further comprising at least one additive selected from amine surfactants, quaternary surfactants, silicone, viscosity modifiers, germicides, fluorescers, perfumes, acids, soil resistant agents, colorants, anti-oxidants, anti-yellowing aids, ironing aids, solvents, and combinations thereof.

11. The composition of claim 1, wherein the vinyl amide polymer has a weight average molecular weight of from 5,000 to 100,000.

12. The composition of claim 1, wherein the vinyl amide polymer has a weight average molecular weight of from 5,000 to 60,000.

13. The composition of claim 1, wherein the vinyl amide polymer comprises from 15 to 100 weight percent of the vinyl amide monomer based on the total monomer weight.

14. A method of cleaning, comprising:

forming a cleaning solution comprising at least one vinyl amide polymer, wherein the vinyl amide polymer has a weight average molecular weight from 5,000 to 200,000, and comprises, as polymerized units, based on total weight of monomer, from 5 to 100 weight percent, of at least one vinyl amide monomer, having the structure of Formula (I),

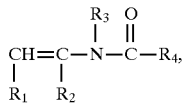

Formula (I)

from 0 to 95 weight percent of one or more vinyl ester monomers, less than 3 weight percent of one or more acrylamide monomers, and less than 3 weight percent of one or more ethylenically unsaturated carboxylic acid monomers;

contacting the vinyl amide polymer with one or more articles; wherein at least one of the articles is an article containing soil, and removing at least a portion of the soil from the article containing soil with the vinyl amide polymer;

wherein $R_1$, $R_2$, and $R_3$ are each independently hydrogen, or a straight, cyclic, or branched chain $C_1$–$C_{10}$ alkyl group;

wherein $R_4$ is hydrogen, a straight or branched chain $C_1$–$C_{18}$ alkyl, aryl, or alkylaryl group, or a substituent of Formula (III), $$-(-(CH_2)_nO)_m-H; \text{ and} \qquad \text{Formula (III)}$$

wherein n is an integer from 1 to 6 and m is an integer from 1 to 30.

15. The method of claim 14, wherein the method further comprises inhibiting the soil removed from depositing on the articles with the vinyl amide polymer.

16. The method of claim 14, wherein the vinyl amide monomer is selected from the group consisting of: N-vinylformamide, N-vinyl acetamide, N-vinyl-N-methyl acetamide and combinations thereof.

17. The method of claim 14, wherein the one or more vinyl ester monomers are selected from the group consisting of: vinyl acetate, vinyl propionate, vinyl butyrate, vinyl pivalate, vinyl laurate, vinyl decanoate, and combinations thereof.

18. The method of claim 14, wherein the vinyl amide polymer has a weight average molecular weight of from 5,000 to 100,000.

19. A method of providing soil resistance to an article, comprising: forming a treatment solution comprising at least one vinyl amide polymer, wherein the vinyl amide polymer has a weight average molecular weight from 5,000 to 200,000, and comprises, as polymerized units, based on total weight of monomer, from 5 to 100 weight percent, of at least one vinyl amide monomer, having the structure of Formula (I),

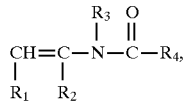

Formula (I)

from 0 to 95 weight percent of one or more vinyl ester monomers, less than 3 weight percent of one or more acrylamide monomers, and less than 3 weight percent of one or more ethylenically unsaturated carboxylic acid monomers; and contacting the vinyl amide polymer with the article to provide soil resistance to the article;

wherein $R_1$, $R_2$, and $R_3$ are each independently hydrogen, or a straight, cyclic, or branched chain $C_1$–$C_{10}$ alkyl group;

wherein $R_4$ is hydrogen, a straight or branched chain $C_1$–$C_{18}$ alkyl, aryl, or alkylaryl group, or a substituent of Formula (III), $$-(-(CH_2)_nO)_m-H; \text{ and} \qquad \text{Formula (III)}$$

wherein n is an integer from 1 to 6 and m is an integer from 1 to 30.

20. The method of claim 19, wherein the vinyl amide monomer is selected from the group consisting of: N-vinylformamide, N-vinyl acetamide, N-vinyl-N-methyl acetamide and combinations thereof.

21. The method of claim 19, wherein the one or more vinyl ester monomers are selected from the group consisting of: vinyl acetate, vinyl propionate, vinyl butyrate, vinyl pivalate, vinyl laurate, vinyl decanoate, and combinations thereof.

22. The method of claim 19, wherein the vinyl amide polymer has a weight average molecular weight of from 5,000 to 100,000.

23. A method of inhibiting the deposition of soil in a washing process, comprising:

forming a cleaning solution comprising at least one vinyl amide polymer, one or more articles, and soil; and inhibiting the soil from depositing on the articles with the vinyl amide polymer;

wherein the vinyl amide polymer has a weight average molecular weight from 5,000 to 200,000, and comprises, as polymerized units, based on total weight of monomer, from 5 to 100 weight percent, of at least one vinyl amide monomer, having the structure of Formula (I),

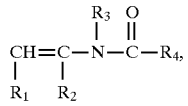

Formula (I)

from 0 to 95 weight percent of one or more vinyl ester monomers, less than 3 weight percent of one or more acrylamide monomers, and less than 3 weight percent of one or more ethylenically unsaturated carboxylic acid monomers; and wherein $R_1$, $R_2$, and $R_3$ are each independently hydrogen, or a straight, cyclic, or branched chain $C_1$–$C_{10}$ alkyl group;

wherein $R_4$ is hydrogen, a straight or branched chain $C_1$–$C_{18}$ alkyl, aryl, or alkylaryl group, or a substituent of Formula (III), $$-(-(CH_2)_nO)_m-H; \text{ and} \qquad \text{Formula (III)}$$

wherein n is an integer from 1 to 6 and m is an integer from 1 to 30.

* * * * *